US007866684B2

(12) United States Patent
Harris, Jr. et al.

(10) Patent No.: US 7,866,684 B2
(45) Date of Patent: Jan. 11, 2011

(54) SKI WITH IMPROVED EDGING CHARACTERISTICS

(76) Inventors: Gerald W. Harris, Jr., 12 E. Beach Dr., Rowayton, CT (US) 06853; Leah K. Harris, 12 E. Beach Dr., Rowayton, CT (US) 06853; Eric C. Witte, 100 Gilbert Hwy., Fairfield, CT (US) 06430

( * ) Notice: Subject to any disclaimer, the term of this patent is extended or adjusted under 35 U.S.C. 154(b) by 0 days.

(21) Appl. No.: 12/288,790

(22) Filed: Oct. 23, 2008

(65) Prior Publication Data

US 2009/0058046 A1 Mar. 5, 2009

Related U.S. Application Data

(62) Division of application No. 11/081,172, filed on Mar. 16, 2005, now Pat. No. 7,445,227.

(51) Int. Cl.
*A63C 5/044* (2006.01)
*A63C 5/048* (2006.01)

(52) U.S. Cl. ..... 280/609; 280/608

(58) Field of Classification Search ..... 280/604, 280/608, 609, 610, 11.18, 28
See application file for complete search history.

(56) References Cited

U.S. PATENT DOCUMENTS

| | | | | | |
|---|---|---|---|---|---|
| 3,643,978 | A * | 2/1972 | Westberg | ..... | 280/28 |
| 3,790,184 | A * | 2/1974 | Bandrowski | ..... | 280/610 |
| 4,778,197 | A * | 10/1988 | Floreani | ..... | 280/602 |
| 4,974,868 | A * | 12/1990 | Morris | ..... | 280/609 |
| 6,062,585 | A * | 5/2000 | Hess | ..... | 280/608 |
| 7,213,827 | B2 * | 5/2007 | Yeh | ..... | 280/605 |

* cited by examiner

*Primary Examiner*—Frank B Vanaman

(57) ABSTRACT

A ski or ski-like device with an improved edging feature to assist skiers in edging during icy conditions. The edging feature includes a structure and method that provides a lateral edge on the inside of the ski that can extend into the snow surface beneath the bottom surface of the ski. When the ski is turned (i.e., rotated about its longitudinal axis) the extended inside edge of the downhill ski digs into the snow surface to provide improved gripping and control. The edge adapted to extend beneath the bottom surface of the ski is provided either by attaching an edge that extends below the bottom surface of the ski, or by providing a bottom surface of the ski in the region adjacent to the extended edge that is arranged to yield under pressure, to expose the extended edge when vertical force is applied to the bottom surface of the ski during a turn.

6 Claims, 5 Drawing Sheets

SKI WITH IMPROVED EDGING CHARACTERISTICS

CROSS REFERENCE TO RELATED APPLICATION

This application is a divisional of application Ser. No. 11/081,172, which issued as U.S. Pat. No. 7,445,227 on Nov. 4, 2008.

FIELD OF THE INVENTION

The present invention generally relates to skis, e.g., skis used for alpine or downhill snow skiing and other ski-like devices, and more particularly to a ski structure and a method for making skis that provides improved edging characteristics.

BACKGROUND OF THE INVENTION

Skis conventionally are made to be used in a variety of snow conditions encountered on ski slopes, ranging from loose powder to ice. Typically, skis have a structure which includes a central structural core, often made of composite materials, to which lateral metallic edges are attached. The skis typically have sidecut contours shaped, e.g., in the form of a parabola, and when the ski is rotated about its longitudinal axis by the skier the edges dig into and grip the snow and cause the ski, and skier, to turn and thereby maneuver down the ski slope. In known fashion, the bottom surfaces of the lateral edges are often ground at a small angle to the bottom of the ski and/or slightly dulled to promote a slight skid and to prevent the skier from "catching an edge" and losing control.

A problem with conventional ski structures has arisen in that in icy conditions or hard-packed snow conditions edging becomes difficult: if the ski is not held at a very precise angle to the surface with proper angulation and weighting, the edges do not dig in and grip the surface to cause a turn, but instead slide across the ice or snow with an accompanying loss of control that may cause the skier to fall or collide with another skier or obstruction. Icy conditions sometimes are widespread, but often they occur intermittently on slopes in areas that receive heavy traffic, and thus changing the edge grind is rarely a practical solution to this problem.

Ski designers and manufacturers have attempted to maximize edging capabilities while at the same time developing and refining the other handling and performance characteristics of their skis. Ski design parameters which affect how a ski will hold an edge on hard snow or ice are camber, sidecut, stiffness, damping and torsional rigidity. These characteristics all affect edging, but they are strongly interrelated and also affect a ski's overall performance and other handling parameters. Thus edging capability has been seen as but one design element intertwined with other performance characteristics and incapable of being enhanced independently.

Accordingly, there is a need to provide a ski structure that is able to provide improved edging characteristics, especially in hard or icy conditions, but also is able to retain its ability to perform well in a variety of other snow conditions.

There is a need to provide a ski design that effectively separates the ski's edging function from the ski's other performance and handling characteristics. There is a further need for a ski that allows skiers of modest ability and strength to edge effectively, and that allows skiers of great ability, such as racers, to edge effectively in high speed or severe slope conditions. Additionally, there remains a need to provide a ski structure and ski-making method that allows skis to be made simply and economically, and that at the same time assist the skier to edge the skis properly in icy conditions.

BRIEF SUMMARY OF THE INVENTION

Briefly, the present invention in one aspect includes a ski with an improved edging feature. The edging feature includes a structure and method that provides a lateral blade or edge on the inside of the ski that can extend beneath the bottom surface of the ski. When the ski is tilted during a turn (i.e., rotated about its longitudinal axis) the extended inside edge of the downhill ski digs into the snow surface to provide improved gripping and control. The extended edge is located adjacent the skier's boot, and allows the skier's weight to be concentrated over a relatively small area for increased surface penetration and improved edging.

In a first aspect of the invention, the ski has a central structural core forming a bottom surface and hard lateral edges attached to each side of the structural core and extending lengthwise of the ski and generally downward to the bottom surface of the ski. The structural core has a footbed region that supports a boot attachment mechanism (typically referred to as a binding). Attached to the ski in the vicinity of the footbed, on the inside of the ski (i.e., the side that would be between the skier's feet) is an edge that is adapted to extend below the bottom surface of the ski to provide improved edge gripping when the ski is turned.

In another aspect of the invention, the extended edge is attached to the ski in lateral alignment with the lateral inside edge and extending below the bottom surface of the ski.

In another aspect of the invention, the extended edge extends below the bottom surface of the ski a distance of about 0.01 to 0.03 inches.

In another aspect of the invention, the extended edge has a bottom surface that is ground differently from the lateral inside edge, e.g., with a hollowed or concave surface similar to that used on ice skates, or with a beveled bottom surface.

In another aspect of the invention, the extended edge is adapted to be removably secured to the ski, e.g., with screw fasteners, and in addition may be adjusted vertically to vary the distance the extended edge extends below the bottom surface of the ski.

In another aspect of the invention, the bottom surface of the ski in the region adjacent to the extended edge is arranged to yield under pressure, to expose the extended edge when vertical force is applied to the bottom surface of the ski during a turn.

In another aspect of the invention, the yielding bottom surface of the ski is formed from an elastomeric material that compresses under pressure to expose the extended edge.

In another aspect of the invention, the yielding bottom surface of the ski is formed with a substantially incompressible bottom layer over a resilient layer or component that compresses under pressure to expose the extended edge.

In another aspect of the invention, the extended edge is attached to the ski in lateral alignment with and co-planar with the bottom surface of the lateral inside edge, and the bottom surface of the ski in the region adjacent to the extended edge is arranged to yield under pressure, to expose the extended edge when vertical force is applied to the bottom surface of the ski during a turn.

In another aspect of the invention, a method provides for making skis with improved edging characteristics. In accordance with the method, a ski is formed by providing a central structural core, forming a bottom surface on the structural core, attaching hard lateral edges to each side of the structural core that extend lengthwise of the ski and generally downward to the bottom surface of the ski, providing a footbed region of the structural core for supporting a boot attachment mechanism (binding), and attaching to the ski in the vicinity of the footbed, on the inside of the ski (i.e., the side that would be between the skier's feet) an edge that is adapted to extend below the bottom surface of the ski to provide improved edge gripping when the ski is turned.

In another aspect of the invention, the method for making skis with improved edging characteristics provides a central structural core with a footbed region for supporting a boot attachment mechanism (binding), forms a bottom surface on the structural core, attaches hard lateral edges to each side of the structural core that extend lengthwise of the ski and generally downward to the bottom surface of the ski, and provides in the vicinity of the footbed, on the inside of the ski (i.e., the side that would be between the skier's feet) a portion of the bottom surface that is arranged to yield under pressure, and an edge that is adapted to be exposed by and extend below the yielded bottom surface of the ski to provide improved edge gripping when the ski is turned.

In still another aspect of the invention, the method of making skis with improved edging characteristics provides the portion of the bottom surface that is arranged to yield under pressure by applying an elastomeric material between the central structural core and the bottom surface layer.

The present invention has several advantages. It enables a ski to be created that is capable of assisting skiers to improve edging in hard or icy conditions yet is useful in a variety of snow conditions. It enables a ski to be created with edging characteristics effectively separated from other performance parameters. Thus, the torsional rigidity heretofore necessary for edging capability, and which reduces the longitudinal ski flexibility necessary for softer snow conditions, can be reduced and a ski can be constructed which is forgiving and easy on soft snow but still achieve tenacious edging on hardpack or ice.

Moreover, the present invention enables a ski to be created that allows conventional skiing techniques to be used yet provides improved performance. Another advantage is that ski lengths may be made much shorter yet with greater control on hard or icy surfaces. A conventional ski's edging and stability are largely dependent on edge length. The present invention reduces the need for edge length to maintain control, and consequently skis may be made 5 to 25 cm. shorter and still achieve better edging, together with the greater maneuverability, faster learning, control and directional stability and reduced cost that shorter skis provide. Another advantage is that skiers that do not have optimum muscle tone and strength to effectively edge a conventional ski will be able to effectively edge skis constructed according to the invention. A further advantage is reduction of muscle fatigue, which allows skiers to ski longer and with less risk of injury. Still other advantages include enabling a ski with improved edging characteristics to be created using available ski materials and conventional manufacturing techniques.

BRIEF DESCRIPTION OF THE DRAWINGS

The foregoing summary of the invention, as well as the following detailed description of the preferred embodiments, is better understood when read in conjunction with the accompanying drawings, which are included by way of example and not by way of limitation with regard to the claimed invention:

DETAILED DESCRIPTION OF THE INVENTION

Figure 1:
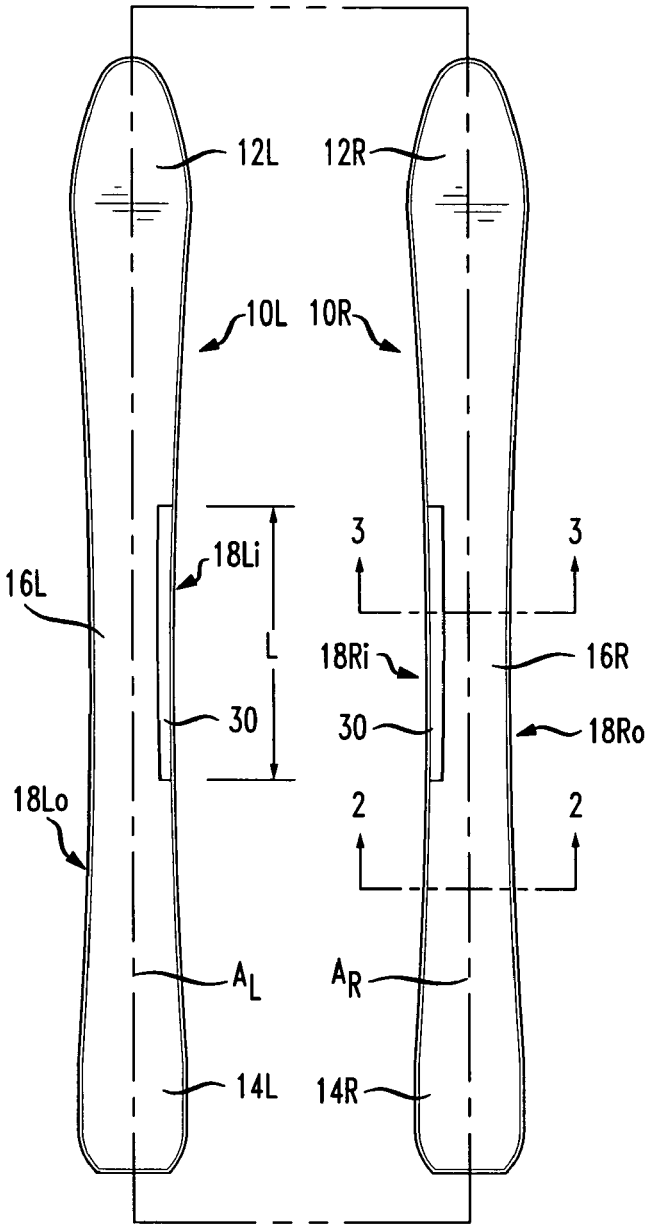
FIG. 1 is a plan view of one embodiment of a pair of skis according to the invention.

FIG. 1 illustrates a pair of skis comprising a left ski 10L and right ski 10R in accordance with the invention with tip regions 12L and 12R, tail regions 14L and 14R, and footbed regions 16L and 16R for supporting a boot attachment mechanism, i.e., a binding (the structure of which is conventional and omitted for clarity). Each ski has a shaped inside and outside edge contour 18Li, 18Lo, and 18Ri, 18Ro, commonly referred to as the ski's "sidecut", often in the shape of a parabola, that forms an arc on the snow surface when the skis are rotated about their longitudinal axes AL, AR and helps the skier turn the skis through the snow.

Figure 2:
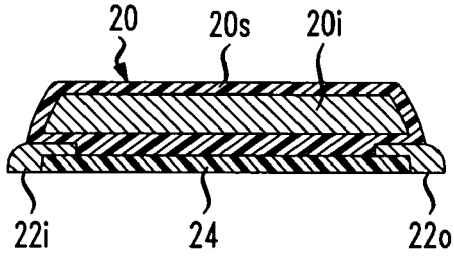
FIG. 2 is a section along lines 2-2 of FIG. 1.

As shown in FIG. 2, the skis 10L and 10R are depicted with a conventional construction including a central structural core 20 designed with appropriate torsional and longitudinal flex characteristics to which metallic inside and outside edges 22*i* and 22*o* are attached mechanically, adhesively or both, substantially throughout the length of the skis. A bottom surface layer 24, or base, is attached to central structural core 20, and the side edges 22*i* and 22*o* extend to the bottom surface 24 to form a substantially planar or flush bottom to the ski. The central structural core 20 typically is designed having controlled flexural elements combined to form a lightweight but stiff interior 20*i* surrounded by an outer protective plastic shell 20*s*. The structural core 20 is designed, in conventional fashion, to provide desired parameters of longitudinal and torsional rigidity with light weight and may be made from a variety of materials including wood laminates, aluminum, carbon fiber, stainless steel, or titanium. The bottom surface or base 24 is conventionally made from a plastic, e.g., polyethylene, to provide a low friction, waxable, repairable sliding surface for contact with the snow.

Figure 3:
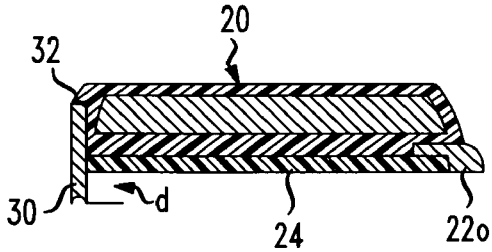
FIG. 3 is a section along lines 3-3 of FIG. 1.
Figure 4:
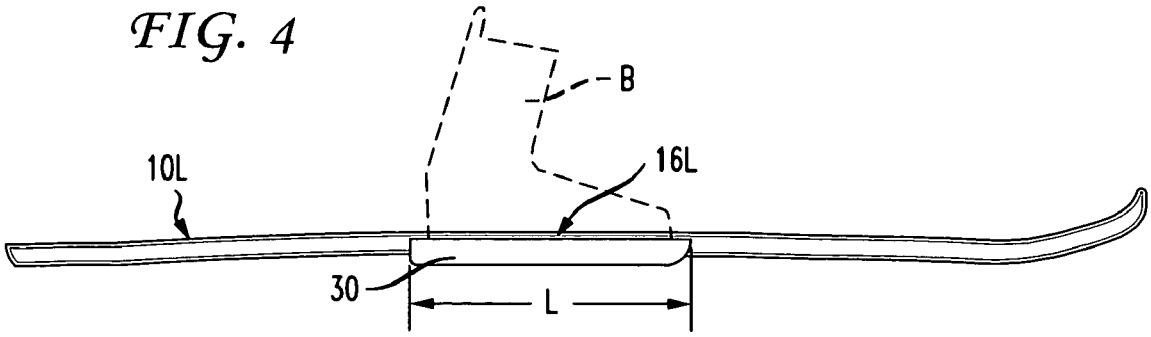
FIG. 4 is a side view looking toward the inside of the left ski of FIG. 1.

In accordance with the invention, the skis 10L and 10R are each provided with an extended edge or blade 30 that is attached to the central structural core 20 on the inside edge of the ski, and that is arranged as shown in FIG. 3 to extend a distance d slightly beneath the bottom surface layer 24. As shown in FIGS. 1 and 4, the extended edge 30 is located lengthwise of the skis adjacent the footbed regions 16L or 16R so it will be adjacent the skier's boot B (FIG. 4), and has a length L, e.g., 5 cm. to 60 cm., that is a minor portion, e.g., 3% to 35% of the ski's overall length. Typically, the extended edge 30 will be slightly longer than the skier's boot B. The extended edge 30 extends below the bottom surface 24 a distance d that is selected to provide good hard snow/ice surface edge gripping qualities when turning without interfering with ski tracking at other times.

The inventors have determined empirically that improved edging characteristics, consistent with minimal interference with other ski uses, are obtained when the distance d is about 0.01 to 0.03 inches. As further shown in FIG. 1, the extended edges 30 have a lateral contour that follows or matches the inside lateral sidecut or shaped contour 18Li, 18Ri of the skis.

The extended edges 30 are attached to the central structural core 20 in side recesses 32 that preferably are located so that the extended edges 30 are aligned laterally with inside edges 22*i* and together with them form a continuous edge contour along the length of the ski.

A ski provided with the extended edge 30 as described above provides improved edging characteristics. When the skier maneuvers the ski into a turn (rotates it about a longitudinal axis), the extended edge 30 has a large portion of the skier's weight concentrated above it to produce a force and pressure that digs the extended edge 30 into the snow or ice surface, avoids slipping, and produces effective edging. Moreover, because the extended edge 30 and inside edge 22*i* are aligned, the extended edge 30 digs a groove or channel into the snow surface that the trailing portion of the inside edge 22*i* will fit into and track along, which increases the edging effectiveness of the ski. In addition, the extended edge 30 can also provide desirable stiffening in the footbed region 16L, 16R. Many skiers, particularly racers, add a metal plate under the boot to increase longitudinal stiffening. The extended edge 30 can supply much of the stiffening such plates are intended to provide. Alternatively, the extended edge can be made in a number of individual segments to provide a controlled longitudinal flex.

Figure 5:
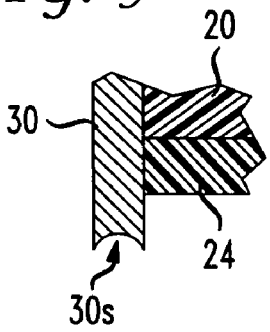
FIG. 5 is a partial section similar to FIG. 3 with enlarged scale for illustrative purposes.
Figure 6:
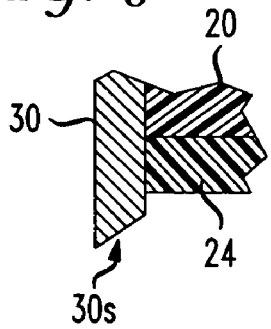
FIG. 6 is a partial section similar to FIG. 5 showing another embodiment of the invention.

Because the extended edge 30 extends a limited length L along the ski, it can be provided with a bottom shape 30*s* that will promote edging in turns without making the overall ski too "grabby" or prone to catch an edge unintentionally and undesirably at other times. Accordingly, as shown in FIG. 5, the bottom shape 30*s* of the extended edge 30 can be made concave, in the manner of an ice skate, or as shown in FIG. 6 the bottom shape 30*s* can be a bevel that provides a sharp corner for digging into the snow surface. Such shapes can be formed by grinding and can be reformed if the bottom shape 30*s* becomes dull or deformed.

Figure 7:
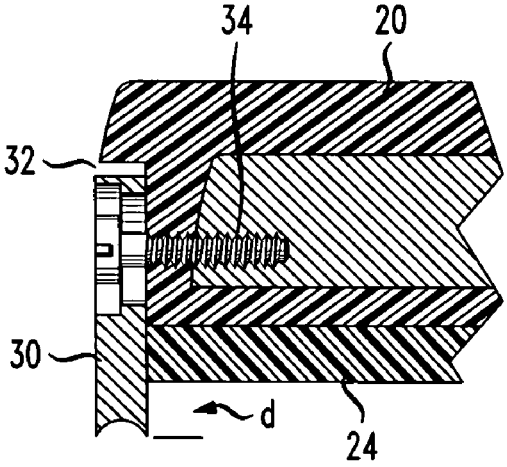
FIG. 7 is a partial section similar to FIG. 3 with enlarged scale for illustrative purposes, showing one edge fastening arrangement.

As shown in FIG. 7, typically the extended edge 30 will be a hard steel blade that is removably attached in recess 32 in the ski structural core 20 with fasteners 34, typically screw fasteners, which allow the extended edge to be removed and replaced. In this manner, the skier can carry a set of extended edges 30 arranged with different bottom shapes 30*s*, or arranged to extend different distances d below the bottom surface 24 of the ski, to allow the ski to be fine-tuned for different conditions or to permit rapid repair if the edge is mangled, for example, by going over a rock.

Figure 8:
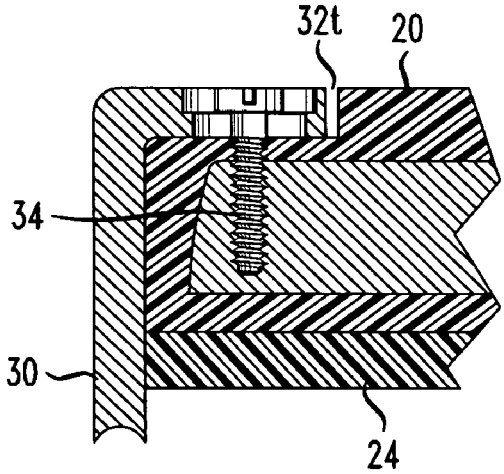
FIG. 8 is a section similar to FIG. 7, showing another edge fastening arrangement.

As shown in FIG. 7, the extended edge 30 can be in the form of a flat strip that is secured in recess 32 of structural core 20 with horizontal fasteners 34 extending into the side of structural core 20. Alternatively, as shown in FIG. 8, the extended edge 30 can be L-shaped in cross-section with a top flange 30*t* that is secured in top recess 32*t* of structural core 20 and through which vertical fasteners 34 extend into the top of structural core 20.

Figure 9:
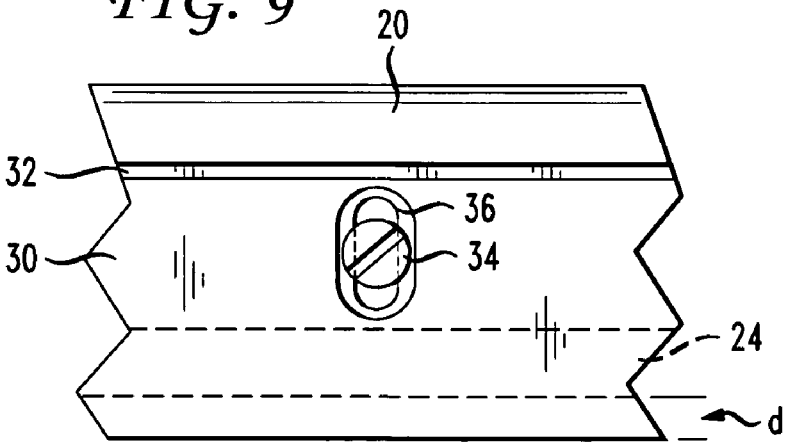
FIG. 9 is partial side view, looking from the left of FIG. 7, showing an adjustable edge fastening arrangement.

When the extended edge 30 is removably secured to structural core 20 with horizontal fasteners 34, it is possible to vary the distance d by which the extended edge extends beneath the bottom ski surface 24. As shown in FIG. 9, this can be accomplished by providing an elongated vertical slot 36 in extended edge 30 through which fastener 34 extends, and which allows the extended edge 30 to be moved up or down a desired amount before fastener 34 is tightened. It will be apparent that while the foregoing description sometimes refers to a single fastener 34, typically a number of fasteners 34 will be positioned along the length of extended edge 30 to secure it to central structural core 20.

Figure 10:
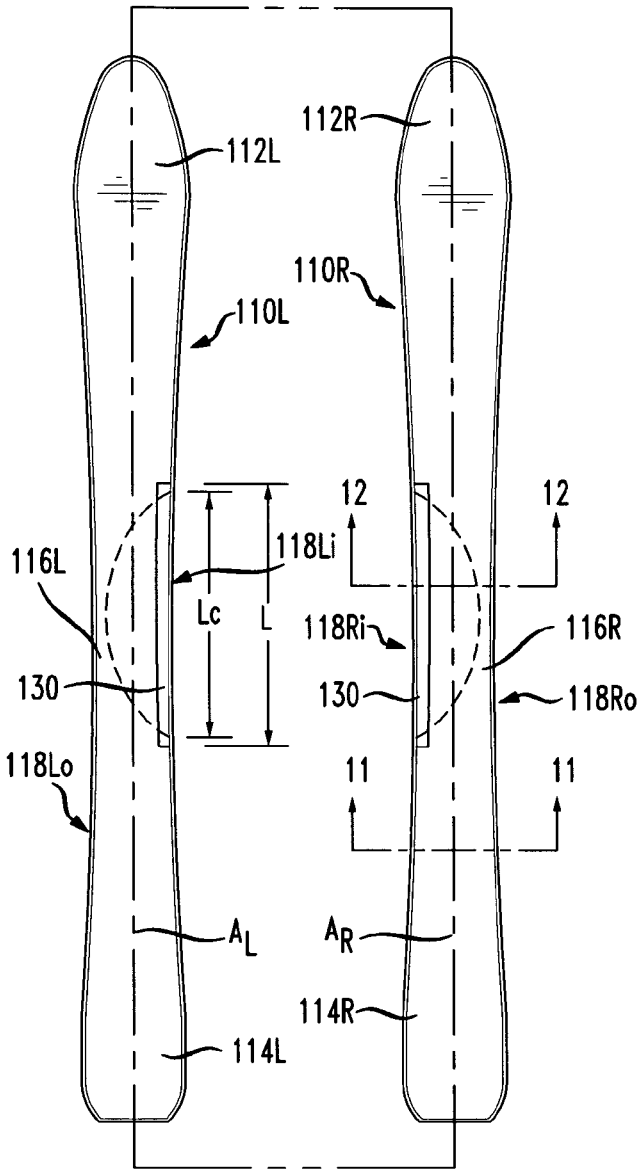
FIG. 10 is a plan view of another embodiment of a pair of skis according to the invention including a compressible layer.
Figure 11:
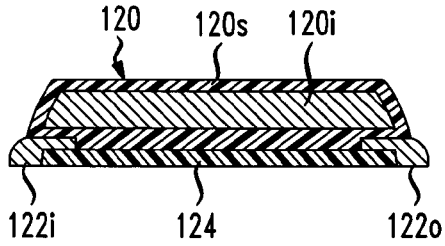
FIG. 11 is a section along lines 11-11 of FIG. 10.
Figure 12:
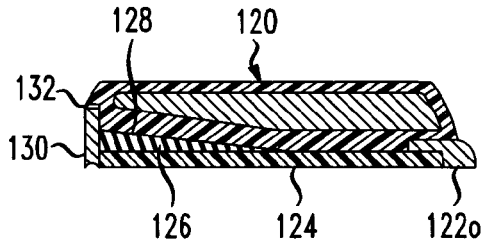
FIG. 12 is a section along lines 12-12 of FIG. 10.

FIGS. 10-12 illustrate another embodiment of left and right skis 10L and 10R according to the invention. Skis 110L and 110R have tip regions 112L and 112R, tail regions 114L and 114R, footbed regions 116L and 116R for supporting boot attachment mechanisms, and inside and outside edge sidecuts or contours 118Lo, 118Li and 118Ro, 118Ri similar to those described above with respect to skis 10L and 10R. A central structural core 120 has attached thereto hard metallic inside and outside edges 122*i* and 122*o* throughout the length of the ski, and a base layer or bottom surface 124, again as described above with respect to skis 10L and 10R.

Figure 12A:
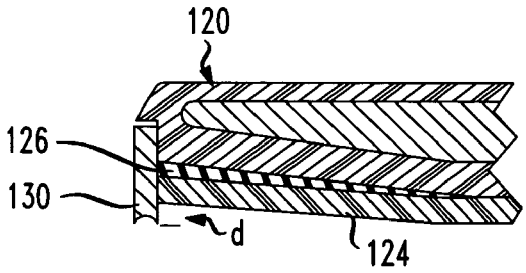
FIG. 12A is a section similar to FIG. 12 showing the ski when the compressible layer is compressed.

As shown in FIG. 12, skis 110L and 110R are each provided with an extendable edge or blade 130 that is attached to the central structural core 120 on the inside edge of the ski in the footbed region 116L, 116R of the ski. Moreover, as shown in FIGS. 10 and 12, between the base layer 124 and structural core 120, both of which are substantially incompressible, there is provided a compressible internal layer 126 arranged to yield under pressure, to expose the extendable edge 130 when vertical force is applied to the bottom surface of the ski during a turn. FIG. 12 shows the compressible layer in its uncompressed state, with the bottom of extended edge 130 substantially flush with bottom surface 124, while FIG. 12A shows the compressible layer 126 in its compressed state, with the bottom surface 124 yielded upward to expose the extended edge a distance d below the bottom surface.

The compressible layer 126, as shown in FIG. 10, is located at the footpad region 116L, 116R of the ski and extends a length Lc that is substantially the length L of extended edge 130 and may have a shape, when viewed from above, like a circular segment. As shown in FIG. 12, the compressible layer 126 fits in a recess 128 provided in structural core 120, and may be tapered, with its greatest thickness adjacent extended edge 130 and least thickness distant from edge 130. Structural core 120 is constructed with recess 128 in the appropriate shape to accommodate compressible layer 126.

Compressible layer 126 may be formed from an elastomeric material that will provide the desired resilience and compressibility at the temperatures encountered when skiing. One example of an elastomeric material thought to be useful for this purpose is the Sorbothane® brand visco-elastic polymer manufactured by Sorbothane, Inc. of Kent, Ohio, further details and properties of which are available from the manufacturer.

Figure 13:
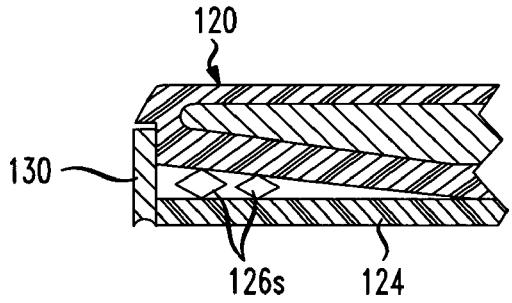
FIG. 13 is a partial sectional view similar to FIG. 12 showing another embodiment of the invention.

Alternatively, as shown in FIG. 13, compressible layer 126 may include spring elements 126*s* which mechanically deform vertically when pressure is applied to the ski bottom. The spring elements 126*s* are shown as diamond-shaped springs but other configurations may be used. Spring elements 126*s* may be used together with or imbedded in an elastomer in compressible layer 126.

The extended edge 130 may be positioned to extend a positive distance d beneath bottom surface 124 when compressible layer 126 is in its uncompressed state. In this arrangement, the extended edge will be further exposed and the distance d will increase as pressure is applied to the bottom of the ski and compressible layer 126 compresses, thereby increasing the ability of extended edge 130 to bite or dig into the snow surface for enhanced edging capability.

Alternatively, the extended edge 130 may be arranged to be flush with bottom surface 124 when compressible layer 126 is in its uncompressed state. In this arrangement, the extended edge will begin to be exposed and the distance d will increase from zero to a positive amount as pressure is applied to the bottom of the ski and compressible layer 126 compresses, thereby allowing the extended edge 130 to bite or dig into the snow surface for enhanced edging capability. In this arrangement, the edge 130 does not extend beneath the bottom surface except when pressure is applied as the ski is turned, and the ski behaves like a conventional ski when edging is not being performed. In this arrangement, the inside edges 122*i* and the extended edge 130 will have their bottom surfaces in alignment, but because the compressible layer 126 is provided only in the central or footbed region 116L, 116R, only the extended edge 130 will become exposed and extend beneath the bottom surface 124 when pressure is applied during a turn. In such an arrangement, the inside edges 122*i* and extended edge 130 may be formed from a single piece of metal or separately.

The extended edge 130 may be provided with a bottom surface 130*s* that is concave or beveled as shown in FIGS. 5 and 6 with respect to the bottom surface 30*s*, and the extended edge 130 may be removably attached to structural core 120 with fasteners 34 as shown in FIGS. 7-9 with respect to extended edge 30 and structural core 20. In these ways, the extended edge 130 may be provided with the advantages of specialized edging surfaces and the removability and vertical adjustability described previously.

Figure 14:
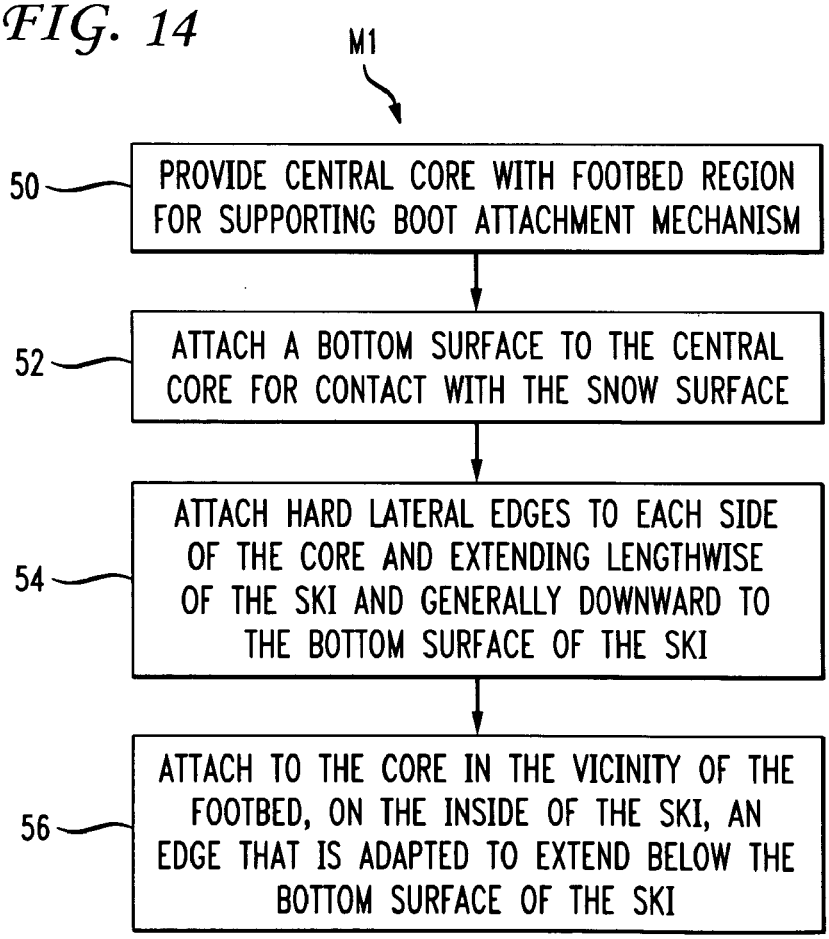
FIG. 14 is a schematic diagram of a method for making the skis of FIG. 1-9.

FIG. 14 illustrates schematically a method M1 for making the skis 10L, 10R illustrated in FIGS. 1-9. As shown in FIG. 14, in step 50 a central structural core 20 with a footbed region for supporting a boot attachment mechanism is provided. In step 52, a bottom surface 24 is attached to the central structural core for contact with the snow surface, and in step 54, hard lateral edges 22*i* and 22*o* are attached to each side of the structural core, extending lengthwise of the ski and generally downward to the bottom surface of the ski. Steps 52 and 54 will be performed in an order that depends on the desired shapes of structural core 20, edges 22*i*, 22*o*, and bottom surface 24 and attaching techniques. For example, edges 22*i*, 22*o* may first be attached to structural core 20 with adhesives or mechanical fasteners, and bottom surface 24 may be applied between the edges 22*i*, 22*o*. In step 56, there is attached to the structural core, in the vicinity of the footbed region 16L, 16R, on the inside of the ski, an edge 30 that is adapted to extend below the bottom surface of the ski. As suggested in the description accompanying FIGS. 7-9, the edge 30 may be attached with removable fasteners 34. At the conclusion of method M1, a ski 10L, 10R has been created simply and inexpensively, with enhanced edging characteristics that are substantially independent of other ski performance characteristics.

Figure 15:
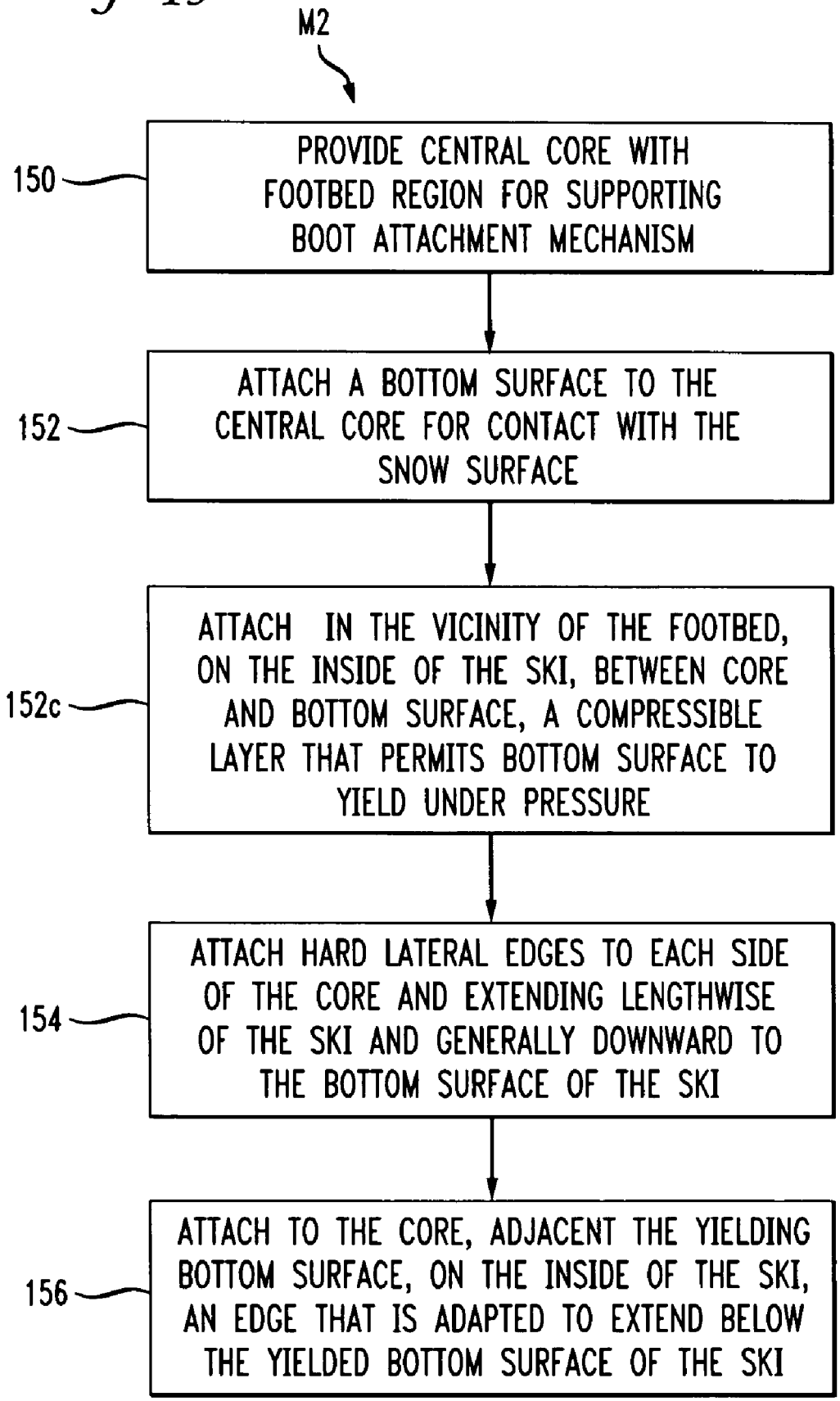
FIG. 15 is a schematic diagram of a method for making the skis of FIG. 10-13.

FIG. 15 illustrates schematically a method M2 for making the skis 110L, 110R illustrated in FIGS. 10-13. As shown in FIG. 15, in step 150 a central structural core 120 with a footbed region 116L, 116R for supporting a boot attachment mechanism is provided. In step 152, a bottom surface 124 is attached to the central structural core for contact with the snow surface, and in step 152*c*, in the vicinity of the footbed, on the inside of the ski, a portion of the bottom surface is provided with a compressible layer that is arranged to yield under pressure. Steps 152 and 152*c* will typically be performed by applying compressible layer 126 to the core 120, and step 152 will typically be performed by then applying bottom surface layer 124 to the compressible layer 126 and to the remaining bottom areas of the structural core 120. In step 154, hard lateral edges 122*i* and 122*o* are attached to each side of the structural core, extending lengthwise of the ski and generally downward to the bottom surface of the ski. In step 156, there is attached to the structural core 120, in the vicinity of the footbed region 116L, 116R, on the inside of the ski, an edge 130 that is adapted to extend below the bottom surface 126 of the ski. Steps 152, 154 and 156 will be performed in an order that depends on the desired shapes of structural core 120, edges 122*i*, 122*o*, bottom surface 124, edge 130 and the attaching techniques that are used to secure them together. For example, edges 122*i*, 122*o* may first be attached to structural core 120 with adhesives or mechanical fasteners, and compressible surface 126 and bottom surface 124 may be applied between the edges 122*i*, 122*o*. The edge 130 may be attached with removable fasteners 34. Alternatively, the edge 130 may be formed integrally with inside edge 122*i* and attached to the structural core 120 simultaneously with edge 122*i*. At the conclusion of method M2, a ski 110L, 110R has been created simply and inexpensively with enhanced edging characteristics that are substantially independent of other ski performance parameters.

The foregoing description has illustrated the invention in the context of conventional downhill skis, applied to the inside edges of a pair of skis designed to be attached independently to skier's legs. It will be apparent that the edging advantages of the present invention will be applicable to other ski-like snow traversing devices which involve edging, such as snowboards, and the term "ski" as used in this description is meant to apply generically to skis, snowboards, and other ski-like devices designed to slide over snow surfaces and having side edges used to grip the snow as the device is tilted (rotated about its longitudinal axis) in the process of making a turn. As applied to snowboards, the single snowboard to which both feet of the rider are attached will have the extended or extendable edges of the present invention located on both lateral sides adjacent the region where the feet are attached to the board. As the board is tilted to either side to make a turn, the extended edge on that side will dig into the snow or ice surface and provide improved edging characteristics of the board. Other examples of ski-like devices to which the invention is applicable are "uni-skis," single skis used by one-legged skiers, to which the extended edges would be applied to both sides, and steerable ski-like sleds or "scooters" or sled runners arranged to tilt while turning.

Thus, a feature for improved edging has been described. The improved edging feature includes a structure and method. While the present invention has been described with reference to preferred and exemplary embodiments, it will be understood by those of ordinary skill in the art that various changes may be made and equivalents may be substituted for elements thereof without departing from the scope of the invention. In addition, many modifications may be made to adapt a particular situation to the teachings of the invention without departing from the scope thereof. Different materials may be used than that shown and suggested that may comprise other implementations of the present invention. For example, other core and edge configurations, and other core, edge and bottom surface and compressible materials may be used. Therefore, it is intended that the invention not be limited to the particular embodiments disclosed, but that the invention include all embodiments falling within the scope of the appended claims.

What is claimed is:

1. A ski with improved edging characteristics comprising a central structural core forming a bottom surface, hard lateral edges attached to each side of the central structural core and extending lengthwise of the ski and generally downward to the bottom surface of the ski, the structural core having a footbed region that supports a boot attachment mechanism, an edge, provided on the ski in alignment with the lateral edge in the vicinity of the footbed region, on the side of the ski, that is adapted to extend below the bottom surface of the ski during a turn, the bottom surface of the ski in the region adjacent to the extended edge being arranged to yield under pressure, to expose the extended edge when vertical force is applied to the bottom surface of the ski during a turn, the yielding bottom surface of the ski having a substantially incompressible layer for contact with the snow surface over a tapered layer made from an elastomeric material that compresses under pressure to expose the extended edge, the elastomeric material layer being tapered with its greatest thickness adjacent the extended edge and least thickness distant from the extended edge, whereby the tapered elastomeric layer yields more nearest the extended edge than distant from the extended edge to expose it when vertical force is applied to the bottom surface of the ski during a turn, and whereby the edge extending below the yielded bottom surface of the ski provides improved lateral edge gripping when the ski is turned and digs a groove into the snow surface that the aligned trailing portion of the lateral edge will fit into and track along, which increases the edging effectiveness of the ski.

2. A ski with improved edging characteristics as claimed in claim 1 wherein the tapered elastomeric layer yields to allow the extended edge to extend below the bottom surface of the ski a distance of about 0.01 to 0.03 inches.

3. A ski with unproved edging characteristics as claimed in claim 1 wherein the extended edge is in lateral alignment with and co-planar with the bottom surface of the lateral side edge, and the bottom surface of the ski in the region adjacent to the extended edge is arranged to yield under pressure above the plane of the bottom surface of the lateral side edge, to expose the extended edge when vertical fierce is applied to the bottom surface of the ski during a turn.

4. A ski with improved edging characteristics as claimed in claim 3 wherein the extended edge is formed integrally with the lateral side edge.

5. A method for making a ski with improved edging characteristics comprising providing a central structural core having a footbed region for supporting a boot attachment mechanism, forming a bottom surface on the structural core, providing in the vicinity of the footbed, on the side of the ski, a portion of the bottom surface that is arranged to yield under pressure, attaching hard lateral edges to each side of the structural core and extending lengthwise of the ski and generally downward to the bottom surface of the ski, providing on the side of the ski an edge that is adapted to extend below the yielded bottom surface of the ski, and forming the yielding bottom surface of the ski with a substantially incompressible layer over a tapered layer made from an elastomeric material that compresses under pressure to expose the extended edge, the elastomeric material layer being tapered with its greatest thickness adjacent the extended edge and least thickness distant from the extended edge, whereby tapered elastomeric layer yields more nearest the extended edge than distant from, the extended edge to expose it when vertical force is applied to the bottom surface of the ski during a turn, and whereby the extended edge provides improved edge gripping when the ski is turned, pressure is applied, and the portion of the bottom surface yields, and whereby the extended edge digs a groove into the snow surface that the trailing portion of the lateral edge will fit into and track along, which increases the edging effectiveness of the ski.

6. A ski with improved edging characteristics comprising a central structural core forming a bottom surface, hard lateral edges attached to each side of the central structural core and extending lengthwise of the ski and generally downward to the bottom surface of the ski, the structural core having a footbed region that supports a boot attachment mechanism, a portion of the bottom surface, in the vicinity of the footbed, on the side of the ski, being arranged to yield under pressure, a portion of the edge in the vicinity or the footbed region, on the side of the ski, being adapted to extend below the yielded bottom surface of the ski into the surface of the snow when the ski is turned by rotating the ski about its longitudinal axis, the yielding bottom surface of the ski having a substantially incompressible layer for contact with the snow surface over a tapered layer made from an elastomeric material that compresses under pressure to expose the extended edge, the elastomeric material layer being tapered with its greatest thickness adjacent the extended edge and least thickness distant from the extended edge, whereby the tapered elastomeric layer yields more nearest the extended edge than distant from the extended edge to expose it when vertical force is applied to the bottom surface of the ski during a turn, and whereby the edge extending into the surface of the snow provides improved edge gripping and digs a groove into the snow surface that the trailing portion of the lateral edge will fit into and track along, which increases the edging effectiveness of the ski.

* * * * *